US007869749B2

(12) United States Patent
Mizumoto et al.

(10) Patent No.: US 7,869,749 B2
(45) Date of Patent: Jan. 11, 2011

(54) SEMICONDUCTIVE RUBBER ROLLER

(75) Inventors: Yoshihisa Mizumoto, Hyogo (JP); Noriaki Hitomi, Hyogo (JP); Hirotoshi Murakami, Hyogo (JP); Yajun Zhang, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 539 days.

(21) Appl. No.: 11/976,741

(22) Filed: Oct. 26, 2007

(65) Prior Publication Data

US 2008/0107456 A1 May 8, 2008

(30) Foreign Application Priority Data

Nov. 2, 2006 (JP) ..... 2006-299685

(51) Int. Cl.

| | |
|---|---|
| ***G03G 15/08*** | (2006.01) |
| ***G03G 15/06*** | (2006.01) |
| ***B25F 5/02*** | (2006.01) |
| ***D02G 3/00*** | (2006.01) |

(52) U.S. Cl. ..... 399/286; 399/279; 492/56; 428/375; 428/379; 430/78

(58) Field of Classification Search ..... 399/286, 399/279

See application file for complete search history.

(56) References Cited

U.S. PATENT DOCUMENTS

| | | | | |
|---|---|---|---|---|
| 7,070,552 | B2 * | 7/2006 | Mizumoto | 492/56 |
| 7,494,754 | B2 * | 2/2009 | Kim et al. | 430/78 |
| 7,555,253 | B2 * | 6/2009 | Mizumoto | 399/286 |
| 7,603,067 | B2 * | 10/2009 | Mizumoto | 399/286 |
| 2002/0085866 | A1 * | 7/2002 | Okayasu et al. | 399/328 |
| 2002/0141775 | A1 * | 10/2002 | Mitsuoka et al. | 399/69 |
| 2004/0030032 | A1 * | 2/2004 | Manabe et al. | 524/502 |
| 2004/0110617 | A1 | 6/2004 | Mizumoto | |
| 2006/0269327 | A1 * | 11/2006 | Mizumoto | 399/176 |
| 2006/0284142 | A1 * | 12/2006 | Mizumoto | 252/500 |
| 2007/0042281 | A1 * | 2/2007 | Orito et al. | 430/59.5 |

FOREIGN PATENT DOCUMENTS

| | | | |
|---|---|---|---|
| JP | 06250534 | A * | 9/1994 |
| JP | 2001-242698 | A | 9/2001 |
| JP | 2001-357735 | A | 12/2001 |
| JP | 2002-23482 | A | 1/2002 |
| JP | 2004-170845 | A | 6/2004 |
| JP | 2005-225969 | A | 8/2005 |

* cited by examiner

*Primary Examiner*—David M Gray
*Assistant Examiner*—Francis Gray
(74) *Attorney, Agent, or Firm*—Birch, Stewart, Kolasch & Birch, LLP

(57) ABSTRACT

A semiconductive rubber roller comprising a toner-transporting portion whose outermost layer is formed essentially of vulcanized rubber containing 0.1 to 30 parts by mass of a phthalocyanine compound for 100 parts by mass of the vulcanized rubber. An electric resistance value of the semiconductive rubber roller which is measured at a temperature of 23° C. and a humidity of 55% is in a range of $10^3$ to $10^9\Omega$, when a voltage of 100V is applied thereto.

9 Claims, 2 Drawing Sheets

SEMICONDUCTIVE RUBBER ROLLER

This nonprovisional application claims priority under 35 U.S.C. §119(a) on Patent Application No(s). 2006-299685 filed in Japan on Nov. 2, 2006, the entire contents of which are hereby incorporated by reference.

BACKGROUND OF THE INVENTION

1. Field of the Invention

The present invention relates to a semiconductive rubber roller and more particularly to a semiconductive rubber roller, having a toner-transporting portion, which is used as a developing roller, a cleaning roller, a charging roller, and a transfer roller and the like mounted on an electrophotographic apparatus.

2. Description of the Related Art

In recent years, in the printing technique using the electrophotographic method, a high-speed printing operation, formation of a high-quality image, formation of a color image, and miniaturization of image-forming apparatuses have been progressively made and become widespread. Toner holds the key to these improvements. To satisfy the above-described demands, it is necessary to form finely divided toner particles, make the diameters of the toner particles uniform, and make the toner particles spherical. Regarding the technique of forming the finely divided toner particles, toner having a diameter not more than 10 μm and not more than 5 μm have been developed recently. Regarding the technique of making the toner spherical, toner having not less than 99% in its deviation from a spherical form has been developed. To form the high-quality image, polymerized toner has come to be widely used instead of pulverized toner conventionally used. The polymerized toner allows the reproduction of dots to be excellent in obtaining printed sheets from digital information and hence a high-quality printed sheet to be obtained.

In compliance with to the improvement in the technique of forming finely divided toner particles, making the diameters of the toner particles uniform, making the toner particles spherical, and the shift from the pulverized toner to the polymerized toner, in an image-forming apparatus of an electrophotographic apparatus such as a laser beam printer, and the like, a semiconductive rubber roller is useful as a developing roller which imparts a high electrostatic property to toner and is capable of efficiently transporting the toner to an electrophotographic photoreceptor without the adhesion of the toner to itself. Users demand that the high-performance function of the semiconductive rubber roller is maintained to the end of the life of a product, for example, the electrophotographic apparatus on which the semiconductive rubber roller is mounted.

To comply with such a demand, semiconductive rubber rollers composed of an ionic-conductive rubber are proposed. More specifically, the following semiconductive rubber rollers are proposed.

For example, as disclosed in Japanese Patent Application Laid-Open No. 2004-170845 (patent document 1), the present inventors proposed the conductive rubber roller composed of an ionic-conductive rubber, having a uniform electrical characteristic, which contains a dielectric loss tangent-adjusting filler to adjust the dielectric loss tangent thereof to 0.1 to 1.5.

The conductive rubber roller is capable of imparting a proper and high electrostatic property to toner, thereby providing a high-quality initial image. In the conductive rubber roller, the charged amount of the toner little decreases even after printing on a considerable number of sheets finishes.

Consequently the conductive rubber roller keeps providing a high-quality image for a long time.

As disclosed in the patent document 1, a rubber component, represented by epichlorohydrin rubber, which contains chlorine atoms is used for the conductive rubber roller to allow the roller to be ionic-conductive. In this case, the rubber component containing the chlorine atoms has a high surface free energy. Thus the toner and an additive to be added thereto and the rubber component containing the chlorine atoms are liable to adhere to each other. When the rubber component containing the chlorine atoms is polymerized with an ionic-conductive ethylene oxide monomer, the conductive rubber roller has a large surface free energy and is liable to get wet, which is a main cause of the adhesion of the toner to the conductive rubber roller. When the oxide film is formed on the surface of the conductive rubber roller by irradiating the surface thereof with ultraviolet rays or exposing it to ozone, the oxygen concentration of the surface of the conductive rubber roller becomes high. Thus the surface free energy increases, which is also a main cause of the adhesion of the toner to the conductive rubber roller.

When the dielectric loss tangent of the conductive rubber roller is set to 0.1 to 1.5, the electrostatic property of the toner can be improved and hence the transport amount of the toner can be decreased. Thus the conductive rubber roller provides a high-quality image such as a half-tone image. On the other hand, the amount of the toner deposited on a developing roller decreases, which is also a main cause of the adhesion of the toner to the conductive rubber roller.

The toner which has adhered to the semiconductive rubber roller does not considerably affect images formed in an early stage and when images are successively printed. But when images are printed in the following conditions (1) through (4), the influence of the toner that has adhered to the semiconductive member cannot be ignored. For example, normally, charged toner is transported to an electrophotographic photoreceptor having an opposite electric charge by a static electricity (Coulomb force). But the transport of the toner by the static electricity is prevented because the adhesion of the toner to the developing roller is high. Thus there arises a problem that the print concentration becomes low, although the charged amount applied to the toner does not change.

(1) When printing is made on a considerable number of sheets of paper and hence toner has an affinity for a developing roller (for example, image is printed at 1% on about 2,000 sheets of paper).

(2) When an average particle diameter of toner is not more than 8 μm and particularly not more than 6 μm.

(3) When printing is made not successively, but is suspended and made the next day.

(4) When a printer is used in a low-temperature and low-humidity environment in which the charged amount of toner is comparatively large.

Proposed and disclosed in Japanese Patent Application Laid-Open No. 2005-225969 (patent document 2) is a semiconductive rubber member composed of the ionic-conductive rubber containing the rubber having the polyether bond. Wax is added to the ionic-conductive rubber to improve processability and prevent nonuniformity in molding and formation of a defective surface such as a cracked surface and decrease the surface free energy so that the additive for toner can be prevented from adhering to the semiconductive rubber member for a long time.

But even in the semiconductive rubber member, there may be a decrease in print concentration in the above-described conditions. Thus there is room for improvement in the prevention of the adhesiveness of the toner to the semiconductive rubber member.

In addition, there may be a slight degree of contamination on the toner and an electrophotographic photoreceptor owing to the presence of a component having a low molecular weight caused by bleed of wax or the like and owing to the revelation of the adhesiveness of the semiconductive rubber member in environment having a comparatively high temperature of about 50° C. Therefore when the semiconductive rubber member is used for a printer or the like demanded to provide a high-quality image, the kind of rubber or polymer which can be used for the semiconductive rubber member is limited.

Proposed and disclosed in Japanese Patent Application Laid-Open No. 2001-357735 (patent document 3) is a conductive member including not less than two function layers (for example, conductive elastic layer) formed on the conductive base material. In the conductive member, at least one function layer other than the outermost layer is coated with a specific treating agent.

Proposed and disclosed in Japanese Patent Application Laid-Open No. 2002-23482 (patent document 4) is a metal developing roller having a resin coating layer, containing the metal phthalocyanine compound, which is formed on its peripheral surface.

When the surface of the conductive member and the developing roller is coated with the coating agent as described in these patent documents, the electrical characteristic of the conductive member is changed owing to the thickness of the coating layer and the dispersibility of a filler contained in the coating agent. Thus the uniformity of the electrical characteristic and the reproducibility of designed values are damaged. Even though materials such as an ionic-conductive rubber, metal, and the like excellent in the uniformity of the electrical characteristic thereof are used as the material to be coated, the above-described problem cannot be solved. Further the cost for producing the conductive member and the developing roller is high.

Patent document 1: Japanese Patent Application Laid-Open No. 2004-170845

Patent document 2: Japanese Patent Application Laid-Open No. 2005-225969

Patent document 3: Japanese Patent Application Laid-Open No. 2001-357735

Patent document 4: Japanese Patent Application Laid-Open No. 2002-23482

SUMMARY OF THE INVENTION

It is an object of the present invention to provide a semiconductive rubber roller to which toner hardly sticks and which consequently does not prevent the toner from being moved by an static electricity.

To achieve the object, the present invention provides a semiconductive rubber roller including a toner-transporting portion whose outermost layer is formed essentially of vulcanized rubber containing 0.1 to 30 parts by mass of a phthalocyanine compound for 100 parts by mass of the vulcanized rubber. An electric resistance value of the semiconductive rubber roller which is measured at a temperature of 23° C. and a humidity of 55% is in a range of $10^3$ to $10^9\Omega$, when a voltage of 100V is applied thereto.

As a result of the present inventor's energetic investigation made to solve the above-described problem, they have found that by using 0.1 to 30 parts by mass of the phthalocyanine compound for 100 parts by mass of the vulcanized rubber composing the outermost layer of the toner-transporting portion, toner easily separates from the surface of the toner-transporting portion.

They have also found that the phthalocyanine compound shows a higher dispersibility when it is added to the vulcanized rubber than when it is added to a liquid thermosetting resin or to a thermoplastic resin plasticized at a high temperature. The vulcanized rubber has a higher viscosity than resin. Thus in mixing the phthalocyanine compound and the vulcanized rubber with each other, an apparatus such as a kneader, a Banbury mixer, a roller, and the like for mixing components of a rubber composition imparts a high shearing force to the vulcanized rubber.

In addition, in the present invention, the vulcanized rubber containing the phthalocyanine compound forms the outermost layer. Thus the thickness of the outermost layer hardly becomes nonuniform.

In the invention of the above-described patent document 4, the peripheral surface of the developing roller is coated in a nonuniform thickness of 1 to 100 μm with the low-dispersive coating agent composed of the resin containing the phthalocyanine compound. The phthalocyanine compound of the present invention has a higher dispersibility than that of the invention of the patent document 4, and the layer of the present invention containing the phthalocyanine compound has a lower extent of nonuniformity than the layer of the patent document 4 containing the phthalocyanine compound. Therefore the semiconductive rubber roller of the present invention displays an effect higher than that of the patent document 4 in preventing the toner from adhering to the semiconductive rubber roller.

The semiconductive rubber roller of the present invention has the toner-transporting portion having the function of transporting the toner held on the surface thereof. The amount of the toner to be transported by the semiconductive rubber roller of the present invention is not specifically limited, but it is preferable that the semiconductive rubber roller transports the toner in an amount of 0.1 to 1.0 mg/cm$^2$ when the semiconductive rubber roller is used as a developing roller and that the semiconductive rubber roller transports the toner in an amount of 0.0001 to 0.1 mg/cm$^2$ when the semiconductive rubber roller is used as a cleaning roller. The construction of semiconductive rubber roller is not specifically limited, provided that the semiconductive rubber roller has the toner-transporting portion. But it is preferable that the semiconductive rubber roller has a sealing member for preventing the leak of toner. The "sealing member" includes not only the one provided to prevent the leak of the toner, but also members that slidingly contact the peripheral surface of the semiconductive rubber roller.

The toner-transporting portion has essentially the outermost layer made of the vulcanized rubber. The construction of the toner-transporting portion is not specifically limited, provided that the toner-transporting portion has the outermost layer. The toner-transporting portion may have a multi-layer construction such as a two-layer construction in dependence on demanded performance. But it is preferable that the toner-transporting portion has only the outermost layer so that the toner-transporting portion having one-layer has little variations in the properties thereof and can be manufactured at a low cost.

The vulcanized rubber composing the outermost layer contains the phthalocyanine compound.

The vulcanized rubber contains 0.1 to 30 parts by mass of the phthalocyanine compound for 100 parts by mass of the vulcanized rubber. If the mixing amount of the phthalocyanine compound is less than 0.1 parts by mass, the adhesiveness of the semiconductive rubber roller cannot be sufficiently reduced. Thus it is difficult for the toner to separate from the surface of the semiconductive rubber roller. Thereby there may occur a problem of the deterioration of print concentration. On the other hand, if the mixing amount of the phthalocyanine compound is more than 30 parts by mass, the semiconductive rubber roller will have a high hardness and there is a possibility that the performance of the semiconductive rubber roller of imparting an electric charge to the toner changes.

As the basic skeleton of the phthalocyanine compound, it has a chemical structure composed of four iso-indoles and four nitrogen atoms positioned at meso positions respectively. Therefore the phthalocyanine compound can be called tetrabenzoazaporphyrin or tetrabenzoporphyrazine. These compounds are included in the "phthalocyanine compound" of the present invention.

The phthalocyanine compound has a structure similar to that of vitamin C, chlorophyll, and porphyrin present in nature and forming hemoglobin and the like. Thus the phthalocyanine compound has a high electron transfer property based on a conjugated p-electron system and assumes blue to green and stable for visible light. Therefore the phthalocyanine compound is mostly used as dye and pigment. Irrespective of uses of the phthalocyanine compound, the known phthalocyanine compound can be used in the present invention.

The phthalocyanine compound to be used in the present invention may have known modifications, provided that it has the above-described basic structure. For example, an isoindole ring may have a substituting group in a chemically permissible range. As the substituting group, it is possible to list halogen atoms (bromine atom, chlorine atom, and the like), straight-chain or branched-chain $C_{1-6}$alkyl group, hydroxy group, straight-chain or branched-chain $C_{1-6}$alkoxy group, carboxyl group, straight-chain or branched-chain $C_{1-6}$alkoxy-carbonyl group, amide group, sulfonamide group, N—$C_{1-12}$alkylaminosulfonyl group (for example, —$SO_2NHC_2H_5$, —$SO_2NHC_4H_9$, —$SO_2NHC_6H_{11}$, —$SO_2NHCH_2C(CH_3)$ H—$C_4H_9$, and —$SO_2NHCH_2C(C_2H_5)$H—$C_4H_9$).

The phthalocyanine compound is classified into metal-free phthalocyanine having a metal not at the center of its molecules and metal phthalocyanine having a metal coordinated at the center of its molecules. In the present invention, both the metal-free phthalocyanine and the metal phthalocyanine can be used.

As the metal of the metal phthalocyanine, most of metals of the periodic law can be used. Although V, Fe, Co, Ni, Pt, Cr, Zn, Al are stable and preferable, Li, Na, K, Be, Mg, Ca, Ba, and Hg can be used as the metal of the metal phthalocyanine.

As the phthalocyanine compound, it is possible to list metal phthalocyanine such as zinc phthalocyanine, cobalt phthalocyanine, iron phthalocyanine, copper phthalocyanine (a type), copper phthalocyanine (β type), sodium phthalocyanine, lead phthalocyanine, nickel phthalocyanine, magnesium phthalocyanine; halogenated metal phthalocyanine such as halogenated copper phthalocyanine, and the like; and phthalocyanine organic compounds. These phthalocyanine compounds can be used singly or as a mixture of two or more thereof.

It is especially favorable to use the copper phthalocyanine and the halogenated copper phthalocyanine as the phthalocyanine compound.

The electric resistance value of the semiconductive rubber roller of the present invention which is measured at the temperature of 23° C. and the humidity of 55% is in the range of $10^3$ to $10^9\Omega$, when the voltage of 100V is applied thereto. The electric resistance value of the semiconductive rubber roller is set favorably to the range of $10^4$ to $10^9\Omega$ and more favorably to the range of $10^5$ to $10^8\Omega$. In using the semiconductive rubber roller of the present invention as a developing roller, it is favorable that the electric resistance value thereof is set to the range of $10^5$ to $10^7\Omega$.

The electric resistance value of the semiconductive rubber roller is not less than $10^3\Omega$ to suppress the generation of a low-quality image by controlling electric current flowing therethrough and prevent electrical discharge to an electrophotographic photoreceptor. Also the electric resistance value of the semiconductive rubber roller is not more than $10^9\Omega$ to keep efficient toner supply and prevent generation of a defective image after a voltage drop of the developing roller when the toner moves to the electrophotographic photoreceptor so that it is possible to securely transport the toner from the developing roller to the electrophotographic photoreceptor. When the electric resistance value of the semiconductive rubber roller is not more than $10^7\Omega$, the semiconductive rubber roller can be used in a wide range and is very useful.

The electric resistance value of the semiconductive rubber roller is measured by using a method which will be described later in the examples of the present invention.

The composition of the vulcanized rubber composing the outermost layer of the semiconductive rubber roller of the present invention is not limited to a specific one, but known rubber compositions may be used. But to increase the effect of adding the phthalocyanine compound to the rubber component, it is preferable to use rubber satisfying at least one of the following three requirements: (1) Rubber has chlorine atoms, (2) Rubber shows ionic conductivity, and (3) Rubber contains an electroconductive material and its SP value is not less than 18.0 $(MPa)^{1/2}$.

The rubber having the chlorine atoms has a characteristic that it is capable of very easily charging toner to be positively charged, but owing to the presence of the chlorine atoms, it has a larger adhesive force than rubber not having the chlorine atoms.

But the rubber containing the phthalocyanine compound is capable of overcoming the disadvantage of the rubber, having the chlorine atoms, which has a high degree of adhesiveness. It has been found through experiments that the chlorine atoms allow the phthalocyanine compound to be very dispersible in the chlorine atom-containing rubber. Therefore the chlorine atom-containing rubber is capable of providing the effect of reducing the adhesiveness owing to the addition of the phthalocyanine compound thereto.

The ionic-conductive rubber allows the uniformity of the electric characteristic and reproducibility of designed values to be easily secured, but causes ion dissociation of water and becomes conductive. Thus the ionic-conductive rubber has affinity for water and has a high surface free energy. Consequently the ionic-conductive rubber is liable to get wet and has a high degree of adhesiveness.

But the ionic-conductive rubber containing the phthalocyanine compound is capable of greatly reducing the adhesiveness thereof and yet keeps the advantage thereof.

By selecting the kind of rubber containing an electroconductive material, it is possible to impart a very high conductivity to toner to be positively charged and toner to be negatively charged. But when the rubber containing the electroconductive material has a SP value of not less than 18.0 $(MPa)^{1/2}$, i.e., when it has a very high polarity, the rubber containing the electroconductive material has a high adhesiveness.

But it is possible to overcome the disadvantage of a high adhesiveness of the rubber containing the electroconductive material by adding the phthalocyanine compound thereto. It has been found through experiments that the phthalocyanine compound is very dispersive in the rubber owing to a high polarity of the rubber and the shearing effect of a filler. Therefore the adhesiveness of the rubber can be reduced greatly by adding the phthalocyanine compound thereto.

The vulcanized rubber composing the outermost layer of the semiconductive rubber roller of the present invention is described in detail below.

It is preferable that the vulcanized rubber composing the outermost layer contains the chlorine atoms.

As the rubber having the chlorine atoms, known rubber can be used, provided that it has the chlorine atoms. For example, it is possible to use unconductive rubber such as chloroprene rubber, chlorinated butyl, chlorosulfonated polyethylene little showing conductivity; and conductive rubber such as epichlorohydrin copolymers.

When the unconductive rubber is used as the rubber having the chlorine atoms, it is preferable to combine the unconductive rubber with the ionic-conductive rubber or mix the unconductive rubber with an ionic-conductive material or/and an electroconductive material to allow the outermost layer to be conductive.

The vulcanized rubber composing the outermost layer may include rubber other than the rubber containing the chlorine atoms. As "other rubber", it is possible to list acrylonitrile butadiene rubber (hereinafter referred to as NBR), acrylonitrile rubber, butadiene rubber, styrene butadiene rubber, urethane rubber, butyl rubber, fluororubber, isoprene rubber, silicone rubber, and the like. In addition, it is possible to exemplify low resistance polymers such as a bi-copolymer of propylene oxide and unsaturated epoxide. As the unsaturated epoxide, it is possible to exemplify allyl glycidyl ether, glycidyl methacrylate, glycidyl acrylate, and butadiene monoxide. These elastomers can be used singly or in combination of two or more thereof.

The mixing amount of the "other rubber" is adjusted in a range in which the mixing amount thereof is not contradictory to the object of the present invention or does not inhibit the dispersibility of the phthalocyanine compound. More specifically, the mixing amount of the "other rubber" is set to favorably not more than 20 mass % and more favorably not more than 10 mass % in the entire rubber component.

As the vulcanized rubber composing the outermost layer, the ionic-conductive rubber can be preferably used.

It is necessary that the outermost layer is conductive so that the electric resistance value of the semiconductive rubber roller is $10^3$ to $10^9\Omega$. The conductivity is classified into electroconductivity and ionic conductivity. It is preferable that the semiconductive rubber roller is ionic-conductive because the ionic conductive semiconductive rubber roller can be provided with a uniform electric characteristic.

When the ionic-conductive rubber is contained in the vulcanized rubber composing the outermost layer, the vulcanized rubber is allowed to be ionic-conductive by adjusting the mixing amount thereof. Needless to say, ionic-conductive materials described below may be used in combination with the ionic-conductive rubber.

When rubber showing the ionic conductivity is not contained in the vulcanized rubber composing the outermost layer, the ionic-conductive material is added to the vulcanized rubber.

As the ionic-conductive rubber, copolymers containing ethylene oxide are listed. As the copolymers containing the ethylene oxide, polyether copolymers and epichlorohydrin copolymers are listed.

Various ionic-conductive materials can be selected. It is possible to use those used as an antistatic agent or a charge control agent. More specifically, as the ionic-conductive materials, it is possible to list quaternary ammonium salt, metal salt of carboxylic acid, derivatives of carboxylic acid such as anhydride of carboxylic acid, esters, and the like, condensate of aromatic compound, organic metal complex, metal salt, chelate compound, monoazo metal complex, acetylacetone metal complex, metal complex of hydroxycarboxylic acid, metal complex of polycarboxylic acid, and metal salt of polyol.

As the ionic-conductive agents, it is possible to list anion-containing salts having fluoro group (F—) and sulfonyl group (—$SO_2$—). More specifically, it is possible to use a salt of bisfluoroalkylsulfonylimide, a salt of tris (fluoroalkylsulfonyl) methane, and a salt of fluoroalkylsulfonic acid. As cations of the above-described salts making a pair with the anions, metal ions of the alkali metals, the group 2A metals, and other metals are favorable. A lithium ion is more favorable. As the ionic-conductive agent, it is possible to list $LiCF_3SO_3$, $LiC_4F_9SO_3$, $LiN(SO_2CF_3)_2$, $LiC(SO_2CF_3)_3$, and $LiCH(SO_2CF_3)_2$.

The mixing amount of the ionic-conductive agent can be appropriately selected in dependence on the kind thereof. For example, it is preferable to set the mixing amount of the ionic-conductive agent to 0.1 to 5 parts by mass for 100 parts by mass of the rubber component.

As the vulcanized rubber composing the outermost layer, rubber containing the electroconductive material and having the SP value of not less than 18.0 $(MPa)^{1/2}$ is preferable.

As the electroconductive agent, it is possible to use conductive carbon black such as Ketjen black, furnace black, acetylene black; conductive metal oxides such as zinc oxide, potassium titanate, antimony-doped titanium oxide, tin oxide; graphite; and carbon fibers. It is preferable to use the conductive carbon black. The mixing amount of the electroconductive agent should be appropriately selected in consideration of properties of the rubber roller such as the electric resistance value and the like. For example, the mixing amount thereof for 100 parts by mass of the rubber component is set to 5 to 35 parts by mass.

The unconductive rubber little showing conductivity and the ionic-conductive rubber can be used as the vulcanized rubber, provided that they have the SP value of not less than 18.0 $(MPa)^{1/2}$.

In blending two or more kinds of rubbers with each other, rubber having the SP value less than 18.0 $(MPa)^{1/2}$ may be used, but the mixing amount thereof is so adjusted that an apparent SP value thereof is not less than 18.0 $(MPa)^{1/2}$. The apparent SP value is obtained by computing the product of an SP value inherent in each rubber component and a mixing ratio of each rubber component when the entirety is supposed to be 1 and finding the sum of the products. For example, supposing that the SP value of a component (a) is Xa, that the mixing ratio thereof is Ya when the entirety is supposed to be 1, that the SP value of a component (b) is Xb, and that the mixing ratio thereof is Yb when the entirety is supposed to be 1, the apparent SP value is $Xa \cdot Ya + Xb \cdot Yb$.

The SP value means a solubility parameter or a solubility constant. As is defined in a book such as "Flow of paint and dispersion of pigment" (compiled by Kenji Ueki and published by KYORITSU SHUPPAN CO., LTD.), the SP value is the square root of a cohesive energy density of each liquid and serves as an index characterizing the solubility. The higher the SP value is, the higher the polarity is. As rubber having the SP value not less than 18.0 $(MPa)^{1/2}$, it is possible to list epichlorohydrin copolymer, polyether copolymer, acrylic rubber, NBR in which the amount of acrylonitrile is not less than 20% and chloroprene rubber.

The following modes are preferable modes of the vulcanized rubber composing the outermost layer:

(a) Epichlorohydrin copolymer (b) Combination of chloroprene rubber, epichlorohydrin copolymer or/and polyether copolymer (c) Combination of chloroprene rubber, NBR, epichlorohydrin copolymer or/and polyether copolymer (d) Combination of chloroprene rubber and NBR Above all, the combination (b-1) of the chloroprene rubber and the epichlorohydrin copolymer, the combination (b-2) of the chloroprene rubber, the epichlorohydrin copolymer, and the polyether copolymer, and the combination (d) of the chloroprene rubber and the NBR are especially favorable.

When not less than two kinds of rubbers are used in combination as the rubber composing the outermost layer, the mixing ratio among them is appropriately selected.

For example, (b-1) in combining the chloroprene rubber and the epichlorohydrin copolymer with each other, supposing that the total mass of a rubber component is 100, the content of the epichlorohydrin copolymer is set to 5 to 95 parts by mass, favorably 20 to 80 parts by mass, and more favorably 20 to 50 parts by mass; and the content of the chloroprene rubber is set to 5 to 95 parts by mass, favorably 20 to 80 parts by mass, and favorably 50 to 80 parts by mass.

(b-2) In combining the chloroprene rubber, the epichlorohydrin copolymer, and the polyether copolymer with one another, supposing that the total mass of a rubber component is 100, the content of the epichlorohydrin copolymer is set to 5 to 90 parts by mass and favorably 10 to 70 parts by mass; the content of the polyether copolymer is set to 5 to 40 parts by mass and favorably 5 to 20 parts by mass; and the content of the chloroprene rubber is set to 5 to 90 parts by mass and favorably 10 to 80 parts by mass. By setting the mixing ratio among the three components to the above-described ratio, it is possible to favorably disperse the three components and improve the properties such as the strength of the vulcanized rubber. It is more favorable to set the mass ratio among the epichlorohydrin copolymer, the chloroprene rubber, and the polyether copolymer to 2 to 5:4 to 7:0.5 to 1.5

(d) In combining the chloroprene rubber and the NBR with each other, supposing that the total mass of a rubber component is 100, the content of the NBR is set to 5 to 95 parts by mass, favorably 20 to 80 parts by mass, and more favorably 20 to 50 parts by mass; and the content of the chloroprene rubber is set to 5 to 95 parts by mass, favorably 20 to 80 parts by mass, and favorably 50 to 80 parts by mass.

As the epichlorohydrin copolymers, it is possible to use epichlorohydrin homopolymer, an epichlorohydrin-ethylene oxide copolymer, an epichlorohydrin-propylene oxide copolymer, an epichlorohydrin-allyl glycidyl ether copolymer, an epichlorohydrin-ethylene oxide-allyl glycidyl ether copolymer, an epichlorohydrin-propylene oxide-allyl glycidyl ether copolymer, and an epichlorohydrin-ethylene oxide-propylene oxide-allyl glycidyl ether copolymer.

As the epichlorohydrin copolymer, a copolymer containing the ethylene oxide is preferable. The copolymer contains the ethylene oxide at not less than 30 mol % nor more than 95 mol %, favorably at not less than 55 mol % nor more than 95 mol %, and more favorably at not less than 60 mol % nor more than 80 mol %. The ethylene oxide has an action of decreasing the specific volume resistance value of the copolymer. When the ethylene oxide is contained in the copolymer at less than 30 mol %, the ethylene oxide decreases the specific volume resistance value of the polymer to a low degree. On the other hand, when the ethylene oxide is contained in the copolymer at more than 95 mol %, the ethylene oxide crystallizes and thus motions of segments of molecular chains thereof are prevented from taking place. Thereby the specific volume resistance value of the copolymer is liable to increase, the hardness of vulcanized rubber increases, and the viscosity of rubber increases before it is vulcanized.

As the epichlorohydrin copolymer, it is especially preferable to use an epichlorohydrin (EP)-ethylene oxide (EO)-allyl glycidyl ether (AGE) copolymer. As the content ratio among the EO, the EP, and the AGE in the epichlorohydrin copolymer, EO:EP:AGE is set to favorably 30 to 95 mol %:4.5 to 65 mol %:0.5 to 10 mol % and more favorably 60 to 80 mol %:15 to 40 mol %:2 to 6 mol %.

As the epichlorohydrin copolymer, it is also possible to use an epichlorohydrin (EP)-ethylene oxide (EO) copolymer. As the content ratio between the EO and the EP, EO:EP is set to favorably 30 to 80 mol %:20 to 70 mol % and more favorably 50 to 80 mol %:20 to 50 mol %.

As the polyether copolymers, it is possible to use an ethylene oxide-propylene oxide-allyl glycidyl ether copolymer, an ethylene oxide-allyl glycidyl ether copolymer, propylene oxide-allyl glycidyl ether copolymer, an ethylene oxide-propylene oxide copolymer, and urethane rubber.

It is favorable that the polyether copolymer contains the ethylene oxide. It is more favorable that the polyether copolymer contains the ethylene oxide at 50 to 95 mol %. When the polyether copolymer contains the ethylene oxide at a high percentage, it is possible to stabilize many ions and thus allows the semiconductive rubber roller to have a low electric resistance. But when the polyether copolymer contains the ethylene oxide at a very high percentage, the ethylene oxide crystallizes and the motions of the segments of the molecular chains thereof are prevented from taking place. Consequently there is a possibility that the specific volume resistance value of the copolymer increases.

It is preferable that the polyether copolymer contains the allyl glycidyl ether in addition to the ethylene oxide. By copolymerizing the allyl glycidyl ether with the ethylene oxide, the allyl glycidyl ether unit obtains a free volume as a side chain. Thus the crystallization of the ethylene oxide is suppressed. As a result, the semiconductive rubber roller has a lower electric resistance than conventional semiconductive rubber rollers. By copolymerizing the allyl glycidyl ether with the ethylene oxide, carbon-to-carbon double bonds are introduced into the polyether copolymer. Thus it is possible to crosslink it with other kind of rubber and thereby prevent occurrence of bleeding and other members such as an electrophotographic photoreceptor from being contaminated.

It is preferable that the polyether copolymer contains 1 to 10 mol % of the allyl glycidyl ether. When the polyether copolymer contains less than one mol % of the allyl glycidyl ether, bleeding and contamination of the other members are liable to occur. On the other hand, when the polyether copolymer contains more than 10 mol % of the allyl glycidyl ether, it is impossible to obtain the effect of suppressing crystallization to a higher extent, and the number of crosslinked points increases after vulcanization. Thus it is impossible to allow the semiconductive rubber roller to have a low electric resistance value. In addition, the tensile strength, fatigue characteristic, and flexing resistance of the semiconductive rubber roller deteriorate.

As the polyether copolymer to be used in the present invention, it is preferable to use an ethylene oxide (EO)-propylene oxide (PO)-allyl glycidyl ether (AGE) terpolymer. By copolymerizing the propylene oxide with the ethylene oxide and the allyl glycidyl ether, it is possible to suppress the crystallization of the ethylene oxide to a higher extent. A preferable content ratio among the ethylene oxide (EO), the propylene oxide (PO), and the allyl glycidyl ether (AGE) in the polyether copolymer is EO:PO:AGE=50 to 95 mol %:1 to 49 mol %:1 to 10 mol %. To effectively prevent bleeding from occurring and the other members from being contaminated, it is preferable that the number-average molecular weight Mn of the ethylene oxide (EO)-propylene oxide (PO)-allyl glycidyl ether (AGE) terpolymer is not less than 10,000.

The chloroprene rubber is produced by emulsion polymerization of chloroprene. In dependence on the kind of a molecular weight modifier, the chloroprene rubber is classified into a sulfur-modified type and a sulfur-unmodified type.

The chloroprene rubber of the sulfur-modified type is formed by plasticizing a polymer resulting from polymerization of sulfur and the chloroprene with thiuram disulfide or the like so that the resulting chloroprene rubber of the sulfur-modified type has a predetermined Mooney viscosity. The chloroprene rubber of the sulfur-unmodified type includes a mercaptan-modified type and a xanthogen-modified type. Alkyl mercaptans such as n-dodecyl mercaptan, tert-dodecyl mercaptan, and octyl mercaptan are used as a molecular weight modifier for the mercaptan-modified type. Alkyl xanthogen compounds are used as a molecular weight modifier for the xanthogen-modified type.

In dependence on a crystallization speed of generated chloroprene rubber, the chloroprene rubber is classified into an intermediate crystallization speed type, a slow crystallization speed type, and a fast crystallization speed type.

Both the chloroprene rubber of the sulfur-modified type and the sulfur-unmodified type can be used in the present invention. But it is preferable to use the chloroprene rubber of the sulfur-unmodified type having the slow crystallization speed.

In the present invention, as the chloroprene rubber, it is possible to use rubber or elastomer having a structure similar to that of the chloroprene rubber. For example, it is possible to use copolymers obtained by polymerizing a mixture of the chloroprene and at least one monomer copolymerizable with the chloroprene. As monomers copolymerizable with the chloroprene, it is possible use 2,3-dichloro-1,3-butadiene, 1-chloro-1,3-butadiene, sulfur, styrene, acrylonitrile, methacrylonitrile, isoprene, butadiene, acrylic acid, methacrylic acid, and esters thereof.

As the NBR, it is possible to use any of low-nitrile NBR containing the acrylonitrile at not more than 25%, intermediate-nitrile NBR containing the acrylonitrile in the range of 25 to 31%, moderate high-nitrile containing the acrylonitrile in the range of 31 to 36%, and high-nitrile NBR containing the acrylonitrile at not less than 36%.

In the present invention, to reduce the specific gravity of the rubber, it is preferable to use the low-nitrile NBR having a small specific gravity. To mix the NBR and the chloroprene rubber with each other favorably, it is preferable to use the intermediate-nitrile NBR or the low-nitrile NBR. More specifically, to make the solubility parameter of the chloroprene rubber and that of the NBR close to each other, the content of the acrylonitrile in the NBR is favorably 15 to 39%, more favorably 17 to 35%, and most favorably 20 to 30%.

Components, other than the rubber component and the phthalocyanine compound, which are contained in the vulcanized rubber composing the outermost layer are described below.

A vulcanizing agent for vulcanizing the rubber component is contained in the vulcanized rubber composing the outermost layer.

As the vulcanizing agent, it is possible to use a sulfur-based vulcanizing agent, a thiourea-based vulcanizing agent, triazine derivatives, peroxides, and monomers. These vulcanizing agents can be used singly or in combination of two or more of them. As the sulfur-based vulcanizing agent, it is possible to use powdery sulfur, organic sulfur-containing compounds such as tetramethylthiuram disulfide, N,N-dithiobismorpholine, and the like. As the thiourea-based vulcanizing agent, it is possible to use tetramethylthiourea, trimethylthiourea, ethylenethiourea, and thioureas shown by $(C_nH_{2n+1}NH)_2C{=}S$ (n=integers 1 to 10). As the peroxides, benzoyl peroxide is exemplified.

The mixing amount of the vulcanizing agent for 100 parts by mass of the rubber component is set to favorably not less than 0.2 nor more than five parts by mass and more favorably not less than one nor more than three parts by mass.

It is preferable to use sulfur and thioureas in combination as the vulcanizing agent.

The mixing amount of the sulfur for 100 parts by mass of the rubber component is favorably not less than 0.1 parts by mass nor more than 5.0 parts by mass and more favorably not less than 0.2 parts by mass nor more than 2 parts by mass. When the mixing amount of the sulfur for 100 parts by mass of the rubber component is less than 0.1 parts by mass, the vulcanizing speed of the entire rubber composition is slow and thus the productivity thereof is low. On the other hand, when the mixing amount of the sulfur for 100 parts by mass of the rubber component is more than 5.0 parts by mass, there is a possibility that the compression set of the rubber roller is high and the sulfur and an accelerating agent bloom.

The mixing amount of the thioureas for 100 g of the rubber component is set to not less than 0.0001 mol nor more than 0.0800 mol, and favorably not less than 0.0009 mol nor more than 0.0800 mol, and more favorably not less than 0.0015 mol nor more than 0.0400 mol. By mixing the thioureas with the rubber component in the above-described range, blooming and contamination of other members hardly occur, and further a molecular motion of the rubber is hardly interfered. Thus the rubber composition is allowed to have a low electric resistance. As the addition amount of the thioureas is increased to increase the crosslinking density, the electric resistance value of the rubber composition can be decreased. That is, when the mixing amount of the thioureas for 100 g of the rubber component is less than 0.0001 mol, it is difficult to improve the compression set of the rubber roller. To decrease the electric resistance value thereof, it is preferable to set the mixing amount of the thioureas to not less than 0.0009 mol. On the other hand, when the mixing amount of the thioureas for 100 g of the rubber component is more than 0.0800 mol, the thioureas bloom from the surface of the rubber roller, thus contaminating the other members such as the electrophotographic photoreceptor and greatly deteriorating the mechanical properties of the rubber roller such as the breaking extension thereof.

In dependence on the kind of the vulcanizing agent, a vulcanizing accelerating agent or a vulcanizing accelerating assistant agent may be added to the rubber component.

As the vulcanizing accelerating agent, it is possible to use inorganic accelerating agents such as slaked lime, magnesia (MgO), and litharge (PbO); and organic accelerating agents shown below. The organic accelerating agent includes guanidines such as di-ortho-tolylguanidine, 1,3-diphenyl guanidine, 1-ortho-tolylbiguanide, salts of the di-ortho-tolylguanidine of dicatechol borate; thiazoles such as 2-melcapto.benzothiazole, dibenzothiazyl disulfide; sulfenamides such as N-cyclohexyl-2-benzothiazylsulfenamide; thiurams such as tetramethylthiuram monosulfide, tetramethylthiuram disulfide, tetraethylthiuram disulfide, and dipentamethylenethiuram tetrasulfide; and thioureas. It is possible to use the above-described substances singly or in combination.

The mixing amount of the vulcanizing accelerating agent is favorably not less than 0.5 nor more than five parts by mass and more favorably not less than 0.5 nor more than two parts by mass for 100 parts by mass of the rubber component.

The following vulcanizing accelerating assistants can be used: metal oxides such as zinc white; fatty acids such as stearic acid, oleic acid, cotton seed fatty acid, and the like; and known vulcanizing accelerating assistants.

The addition amount of the vulcanizing accelerating agent for 100 parts by mass of the rubber component is favorably not less than 0.5 parts by mass nor more than 10 parts by mass and more favorably not less than two parts by mass nor more than eight parts by mass.

When the rubber having the chlorine atoms is used as the vulcanized rubber composing the outermost layer, it is preferable that the vulcanized rubber contains an acid-accepting agent. By using the semiconductive rubber composition containing the acid-accepting agent, it is possible to prevent chlorine gas generated in a vulcanizing operation from remaining behind and the other members from being contaminated.

As the acid-accepting agent, it is possible to use various substances acting as acid acceptors. As the acid-accepting agent, hydrotalcites or magnesium oxide can be favorably used because they have preferable dispersibility. The hydrotalcites are especially favorable. It is possible to obtain a high acid-accepting effect by using the hydrotalcites in combination with a magnesium oxide or a potassium oxide. Thereby it is possible to securely prevent other members from being contaminated.

The mixing amount of the acid-accepting agent for 100 parts by mass of the rubber component is favorably not less than 1 nor more than 10 parts by mass and more favorably not less than 1 nor more than 5 parts by mass. The mixing amount of the acid-accepting agent for 100 parts by mass of the rubber component is favorably not less than one part by weight to allow the acid-accepting agent to effectively display the effect of preventing a vulcanizing operation from being inhibited and the other members from being contaminated. The mixing amount of the acid-accepting agent for 100 parts by mass of the rubber component is favorably not more than 10 parts by mass to prevent the hardness of the semiconductive rubber roller from increasing.

When the ionic-conductive rubber is used as the vulcanized rubber composing the outermost layer, it is preferable to add a dielectric loss tangent-adjusting agent to the ionic-conductive rubber to impart a high electrostatic property to toner and keep the electrostatic property continue for a long time.

As the dielectric loss tangent-adjusting agent, weakly conductive carbon black or calcium carbonate treated with fatty acid is used. It is preferable to use the weakly conductive carbon black.

The weakly conductive carbon black is large in its particle diameter, has a low extent of development in its structure, and has a small degree of contribution to the conductivity of the semiconductive rubber roller. The semiconductive rubber roller containing the weakly conductive carbon black is capable of obtaining a capacitor-like operation owing to a polarizing action without increasing the electrical conductivity thereof and controlling the electrostatic property to be imparted to the toner without deteriorating the uniformity of the electric resistance thereof.

It is possible to efficiently obtain the above-described effect by using the weakly conductive carbon black whose primary particle diameter is not less than 80 nm and preferably not less than 100 nm. When the primary particle diameter is not more than 500 nm and preferably not more than 250 nm, it is possible to remarkably reduce the degree of the surface roughness of the outer layer. It is preferable that the weakly conductive carbon black is spherical or approximately spherical because the weakly conductive carbon black has a small surface area.

Various weakly conductive carbon blacks can be selectively used. For example, it is favorable to use carbon black produced by a furnace method or a thermal method providing particles having large diameters. It is more favorable to use the carbon black produced by the furnace method than by the thermal method. SRF carbon, FT carbon, and MT carbon are preferable in terms of the classification of carbon. The carbon black for use in pigment may be used.

It is preferable to use not less than five parts by mass of the weakly conductive carbon black for 100 parts by mass of the rubber component so that the weakly conductive carbon black substantially displays the effect of reducing the dielectric loss tangent of the semiconductive rubber roller. It is preferable to use not more than 70 parts by mass of the weakly conductive carbon black for 100 parts by mass of the rubber component to prevent an increase in the hardness of the semiconductive rubber roller so that the semiconductive rubber roller does not damage other members which contact the semiconductive rubber roller, prevent a decrease in the wear resistance thereof, and obtain the characteristic of the ionic conductivity that a voltage fluctuation of the resistance thereof is small for an applied voltage. To favorably mix the weakly conductive carbon black with other components, the mixing amount of the weakly conductive carbon black is set to more favorably 10 to 60 parts by mass and most favorably 25 to 55 parts by mass for 100 parts by mass of the rubber component.

The calcium carbonate treated with the fatty acid is more active than ordinary calcium carbonate and lubricant, because the fatty acid is present on the interface of the calcium carbonate. Thus it is possible to realize a high degree of dispersion of the calcium carbonate treated with the fatty acid easily and reliably. When the polarization action is accelerated by the treatment of the calcium carbonate with the fatty acid, there is an increase in the capacitor-like operation in the rubber owing to the above-described two actions. Thus the dielectric loss tangent of the semiconductive rubber roller can be efficiently reduced. It is preferable that the surfaces of particles of the calcium carbonate treated with fatty acid are entirely coated with the fatty acid such as stearic acid.

It is preferable that the mixing amount of the calcium carbonate treated with fatty acid is 30 to 80 parts by mass and favorably 40 to 70 parts by mass for 100 parts by mass of the rubber component. It is preferable that the mixing amount of the calcium carbonate treated with fatty acid is not less than 30 parts by mass for 100 parts by mass of the rubber component so that it substantially displays the effect of reducing the dielectric loss tangent of the semiconductive rubber roller. To prevent the rise of the hardness of the semiconductive rubber roller and a fluctuation of the electric resistance thereof, it is preferable that the mixing amount of the calcium carbonate treated with fatty acid is not more than 80 parts by mass for 100 parts by mass of the rubber component.

In addition to the above-described components, the conductive rubber roller may contain the following additives unless the use thereof is not contradictory to the object of the present invention: a plasticizing agent, a processing aid, a deterioration retarder, a filler, a scorch retarder, an ultraviolet ray absorber, a lubricant, a pigment, an antistatic agent, a flame retardant, a neutralizer, a nucleating agent, an agent for preventing the generation of air-bubbles, and a crosslinking agent.

As the plasticizer, it is possible to use dibutyl phthalate (DBP), dioctyl phthalate (DOP), tricresyl phosphate, and wax. As the processing aid, fatty acids such as stearic acid can be used. It is preferable that the mixing amounts of these plasticizing components are not more than five parts by mass for 100 parts by mass of the rubber component to prevent bleeding from occurring when the oxide film is formed on the surface of the semiconductive rubber roller and other members such as the electrophotographic photoreceptor from being contaminated when the conductive rubber roller is mounted on a printer and the like and when the printer or the like is operated. In this respect, polar wax is most favorably used as the plasticizer.

As the deterioration retarder, various age resistors and antioxidants can be used. When the antioxidant is used as the deterioration retarder, it is preferable to appropriately select the mixing amount thereof to efficiently form the oxide film on the surface of the semiconductive rubber roller as desired.

The following fillers can be used: powdered substances such as titanium oxide, aluminum oxide (alumina), zinc oxide, silica, carbon, carbon black, clay, talc, calcium carbonate, magnesium carbonate, and aluminum hydroxide. The rubber roller containing the filler is allowed to have an improved mechanical strength and the like. Above all, when the titanium oxide or/and the aluminum oxide are coexistent with the phthalocyanine compound, it is possible to increase the effect of adding the phthalocyanine compound to the vulcanized rubber and improve the dispersibility of the phthalocyanine compound in the rubber.

The mixing amount of the filler for 100 parts by mass of the rubber component is favorably not more than 60 parts by mass and more favorably not more than 50 parts by mass. The weakly conductive carbon black serves as the filler in addition to the above-described role thereof.

As the scorch retarder, it is possible to use N-(cyclohexylthio)phthalimide; phthalic anhydride, N-nitrosodiphenylamine, 2,4-diphenyl-4-methyl-1-pentene. It is preferable to use the N-(cyclohexylthio)phthalimide. These scorch retarders can be used singly or in combination. The mixing amount of the scorch retarder for 100 parts by mass of the rubber component is favorably not less than 0.1 nor more than 5 parts by mass and more favorably not less than 0.1 parts by mass nor more than 1 part by weight.

The semiconductive rubber roller of the present invention can be produced by carrying out a conventional method.

The method of producing the semiconductive rubber roller consisting of the outermost layer is described below.

After components composing the toner-transporting portion are kneaded by using a mixing apparatus such as a kneader, a roller, a Banbury mixer or the like, a mixture is tubularly preformed by using a rubber extruder. After the preformed tube is vulcanized, a shaft is inserted into a hollow portion of the preform and bonded thereto, the surface thereof is polished. After the tube is cut to a predetermined size, it is polished appropriately so that it is roller-shaped.

The optimum vulcanizing time period should be set by using a vulcanization testing rheometer (for example, curelastmeter). To prevent the contamination of the other members and reduce the degree of the compression set of the semiconductive rubber roller, it is preferable to set conditions in which a vulcanization amount is obtained to a possible highest extent. More specifically, the vulcanizing temperature is set to favorably 100 to 220° C. and more favorably 120 to 180° C. The vulcanizing period of time is set to favorably 15 to 120 minutes and more favorably 30 to 90 minutes. When the semiconductive rubber roller is composed of two or more layers, in accordance with the above-described method, the rubber is vulcanized by using an extrusion vulcanizing can in a plurality of layers or the rubber is vulcanized by continuous vulcanization.

It is preferable to form an oxide film, on the outermost layer, which has a low friction coefficient. Thereby toner separates easily from the outermost conductive rubber layer. Hence images can be formed easily. Consequently images of high quality can be obtained.

It is preferable that the oxide film has a large number of C═O groups or C—O groups. The oxide film can be formed by irradiating the surface of the outermost layer with ultraviolet rays and/or ozone and oxidizing the surface of the outermost layer. It is preferable to form the oxide film by irradiating the surface of the outermost layer with ultraviolet rays because the use of the ultraviolet rays allows a treating period of time to be short and the oxide film-forming cost to be low.

The treatment for forming the oxide film can be made in accordance with a known method. For example, the surface of the outermost layer is irradiated with ultraviolet rays having a wavelength of 100 nm to 400 nm and favorably 100 nm to 300 nm for 30 seconds to 30 minutes and favorably one to 10 minutes while the semiconductive rubber roller is rotating, although the wavelength of the ultraviolet rays varies according to the distance between the surface of the outermost layer and an ultraviolet ray irradiation lamp and the kind of rubber.

When the outermost layer is irradiated with ultraviolet rays, the mixing amount of rubber such as NBR which is deteriorated with ultraviolet rays is favorably not more than 50 parts by mass for 100 parts by mass of the rubber component.

Supposing that the electric resistance of the conductive rubber roller is R50 when a voltage of 50V is applied thereto before the oxide film is formed thereon and that the electric resistance thereof is R50a when the voltage of 50V is applied thereto after the oxide film is formed thereon, it is favorable that $\log(R50a)-\log(R50)=0.2$ to 1.5. By setting the electric resistance of the conductive rubber roller to the above-described range, it is possible to provide the semiconductive rubber roller with improved durability, reduce the variation of the electric resistance thereof when it is in operation, reduce a stress on toner, and prevent the electrophotographic photoreceptor from being contaminated or damaged. Because the index value of the electric resistance value of the conductive rubber roller is set to a low voltage of 50 volts at which a voltage is stably applied thereto, it is possible to capture a slight rise of the electric resistance caused by the formation of the oxide film. The lower limit value of $\log(R50a)-\log(R50)$ is more favorably 0.3 and most favorably 0.5. The upper limit value of $\log(R50a)-\log(R50)$ is more favorably 1.2 and most favorably 1.0.

It is preferable that the semiconductive rubber roller of the present invention produced as described above has the following properties.

To impart a high electrostatic property to toner and improve the durability of the electrostatic property thereof, it is preferable that the dielectric loss tangent of the semiconductive rubber roller of the present invention is in the range of 0.1 to 1.8 when an alternating voltage of 5V is applied thereto at a frequency of 100 Hz.

In the electrical characteristics of the semiconductive rubber roller, the dielectric loss tangent means an index indicating the flowability of electricity (conductivity) and the degree of influence of a capacitor component (electrostatic capacity). In other words, the dielectric loss tangent is a parameter indicating a phase delay when an alternating current is applied to the semiconductive rubber roller, namely, the rate of the capacitor component when a voltage is applied thereto. That is, the dielectric loss tangent is indicated by a charged amount of toner generated when the toner is brought into contact with the developing roller at a high voltage by an amount regulation blade and a charged amount which escapes to the semiconductive rubber roller before the toner is transported to the electrophotographic photoreceptor. Thus the dielectric loss tangent is an index showing the charged amount of the toner immediately before the toner contacts the electrophotographic photoreceptor.

When the dielectric loss tangent is large, it is easy to flow electricity (electric charge) through the roller, which makes the progress of polarization slow. On the other hand, when the dielectric loss tangent is small, it is not easy to flow electricity (electric charge) through the roller, which makes the progress of the polarization fast. Thus when the dielectric loss tangent is small, the roller has a high capacitor-like characteristic and it is possible to maintain an electric charge on the toner generated by frictional charge without escaping the electric charge from the roller. That is, it is possible to obtain the effect of imparting the electrostatic property to the toner and maintaining the electrostatic property imparted thereto. To obtain the effect, the dielectric loss tangent is set to not more than 1.8. To prevent a print concentration from becoming too low owing to an excessive increase of the charged amount and prevent the semiconductive rubber roller from becoming hard owing to the addition of a large amount of additives used to adjust the dielectric loss tangent, the dielectric loss tangent is set to not less than 0.1. The dielectric loss tangent is more favorably not less than 0.3 and most favorably not less than 0.5. The dielectric loss tangent is favorably not more than 1.5, more favorably not more than 1.0, and most favorably not more than 0.8.

The dielectric loss tangent is measured as follows:

As shown in FIG. 3, a metal shaft 2 and a metal plate 53 serve as an electrode respectively. An alternating voltage of 5V is applied to a toner-transporting portion 1 placed on the metal plate 53 at a frequency of 100 Hz. An R (electric resistance) component and a C (capacitor) component are measured separately by an LCR meter (AG-4311B, manufactured by Ando Electoric Co., Ltd.) at a constant temperature of 23° C. and a constant relative humidity of 55%. The dielectric loss tangent is computed from the value of R and C by using the following equation.

$$\text{Dielectric loss tangent } (\tan\delta) = G/(\omega C),\ G = 1/R$$

The dielectric loss tangent is found as G/ωC by modeling the electrical characteristic of one roller as a parallel equivalent circuit of the electric resistance component of the roller and the capacitor component thereof.

The reason a slight voltage of 5V is applied to the semiconductive rubber roller as the condition of measuring the dielectric loss tangent is as follows: Supposing that when the semiconductive rubber roller used as a developing roller holds toner thereon or when the toner is transported to the electrophotographic photoreceptor, a very small voltage fluctuation occurs. The frequency of 100 Hz is suitable in consideration of the number of rotations of the developing roller and nips between the developing roller and the electrophotographic photoreceptor, the blade, and a toner supply roller with which the developing roller contacts or to which the developing roller is proximate.

It is preferable that the friction coefficient of the surface of the semiconductive rubber roller is favorably in the range of 0.1 to 1.0, more favorably in the range of 0.1 to 0.8, and most favorably in the range of 0.1 to 0.6. In this range, it is possible to improve the electrostatic property of the toner and prevent the toner from adhering to the surface of the semiconductive rubber roller. If the friction coefficient of the semiconductive rubber roller is more than 1.0, a large stress such as a large shearing force is applied to the toner. Further, a portion of the semiconductive rubber roller making a sliding contact with other members of an image-forming apparatus has a high calorific value and a large amount of wear owing to friction therebetween. On the other hand, if the friction coefficient of the semiconductive rubber roller is less than 0.1, the toner slips and hence it is difficult to transport a sufficient amount of the toner and sufficiently charge the toner.

With reference to FIG. 4, the friction coefficient of a semiconductive rubber roller 43 can be computed by substituting a numerical value measured with a digital force gauge 41 of an apparatus into the Euler's equation. The apparatus has a digital force gauge (Model PPX-2T manufactured by IMADA CO., LTD.) 41, a friction piece (commercially available OHP film, made of polyester, in contact with the peripheral surface of the semiconductive rubber roller 43 in an axial length of 50 mm) 42, a weight 44 weighing 20 g, and the semiconductive rubber roller 43.

The surface roughness Rz of the semiconductive rubber roller of the present invention is favorably not more than 10 μm and more favorably not more than 8 μm. By setting the surface roughness Rz of the semiconductive rubber roller to the above-described range, the diameters of concave and convex portions of the surface thereof are smaller than those of toner particles. Thus the toner can be uniformly transported, and the flowability of the toner is favorable. Consequently it is possible to efficiently impart electrostatic property to the toner. It is preferable that the surface roughness Rz is small but is normally not less than 1 μm. When the surface roughness Rz is less than 1 μm, it is difficult to transport the toner.

The surface roughness Rz is measured in conformity to JIS B 0601 (1994).

It is preferable that the semiconductive rubber member of the present invention has a hardness not more than 70 degrees when the hardness thereof is measured in conformity to a durometer hardness test type A specified in JIS K 6253. This is because the softer the semiconductive rubber member is, the larger is the nip. Consequently transfer, electric charging, and development can be efficiently accomplished. In addition, it is possible to reduce mechanical damage to other members such as the electrophotographic photoreceptor and the like. It is preferable that the lower limit value of the hardness of the semiconductive rubber member is set as low as possible. But in view of the wear resistance thereof, the hardness thereof is set to favorably not less than 40 degrees and more favorably not less than 50 degrees.

The compression set of the semiconductive rubber member is set to favorably not more than 10% and more favorably not more than 9.5% when the compression set is measured in accordance with JIS K 6262. When the compression set is not more than 10%, the semiconductive rubber rollers have a small dimensional change and have improved durability. Thereby an image-forming apparatus is capable of maintaining a high accuracy for a long time. The lower limit of the compression set of the semiconductive rubber member is set to favorably 1% to optimize a vulcanization condition and achieve a stable mass-productivity. As the conditions in which the compression is measured, the measuring temperature, the measuring period of time, and the compression percentage are set to 70° C., 24 hours, and 25% respectively.

It is preferable that the semiconductive rubber roller of the present invention is used for an image-forming mechanism of an electrophotographic apparatus of office automation appliances such as a laser beam printer, an ink jet printer, a copying machine, a facsimile, and the like or an ATM.

Above all, the semiconductive rubber roller of the present invention is preferably used as a developing roller for transporting unmagnetic one-component toner to the electrophotographic photoreceptor. Roughly classifying the developing method used in the image-forming mechanism of the electrophotographic apparatus in the relation between the electrophotographic photoreceptor and the developing roller, the contact type and the non-contact type are known. The semiconductive rubber roller of the present invention can be utilized in both types. It is preferable that the semiconductive rubber roller of the present invention used as the developing roller contacts the electrophotographic photoreceptor.

In addition to the developing roller, the semiconductive rubber roller of the present invention can be used as a charging roller for uniformly charging an electrophotographic drum, a transfer roller for transferring a toner image from the electrophotographic photoreceptor to a transfer belt and paper, a toner supply roller for transporting toner, and a cleaning roller for removing residual toner.

In the present invention, it is possible to decrease the degree of adhesiveness of toner to the toner-transporting portion by adding a specific amount of the phthalocyanine compound to the vulcanized rubber composing the outermost layer of the toner-transporting portion. Rubber components such as the rubber containing chlorine and the ionic-conductive rubber are conventionally used to impart various characteristics to the vulcanized rubber. In these rubbers, surface free energies are high, and toner is liable to adhere to the surface of the semiconductive rubber roller and the like. The effect of decreasing the degree of adhesiveness of the toner by adding the phthalocyanine compound can be conspicuously displayed for the rubber containing chlorine, the ionic-conductive rubber, and the like.

The effect of decreasing the degree of adhesiveness of the toner is not affected by the kind and composition of the rubber component, whether the oxide film is formed on the surface of the semiconductive rubber roller, the property of the semiconductive rubber roller, and the dielectric loss tangent thereof. This effect does not depend on environment or printing conditions, but can be maintained even when the toner has affinity for the semiconductive rubber roller.

Consequently when the semiconductive rubber roller of the present invention is used as a developing roller of an image-forming apparatus, the image-forming apparatus provides prints with a stable concentration for a long time without decline of the printing concentration.

DETAILED DESCRIPTION OF THE PREFERRED EMBODIMENTS

The embodiments of the present invention are described below with reference to the drawings.

Figure 1:
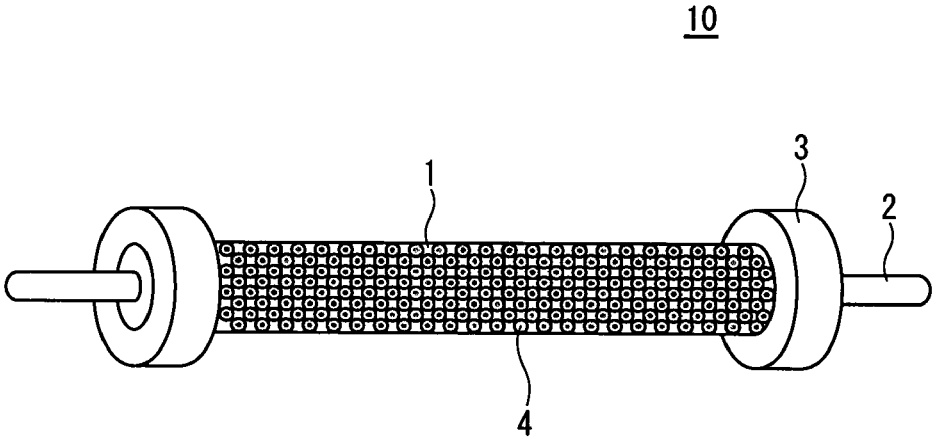
FIG. 1 is a schematic view showing a semiconductive rubber roller of the present invention.

As shown in FIG. 1, a semiconductive rubber roller 10 used as a developing roller has a cylindrical toner-transporting portion 1 having a thickness of 0.5 mm to 15 mm, favorably 3 to 15 mm, and more favorably 5 to 15 mm; a columnar shaft 2 inserted into a hollow portion of the semiconductive rubber roller 10 by press fit; and a pair of annular sealing portions 3 for preventing leak of a toner 4. The toner-transporting portion 1 and the shaft 2 are bonded to each other with a conductive adhesive agent. An oxide film is formed on the uppermost surface of the toner-transporting portion 1.

The reason the thickness of the toner-transporting portion 1 is set to 0.5 mm to 15 mm is as follows: If the thickness of the toner-transporting portion 1 is less than 0.5 mm, it is difficult to obtain an appropriate nip. If the thickness of the toner-transporting portion 1 is more than 15 mm, the toner-transporting portion 1 is so large that it is difficult to produce a small and lightweight an apparatus in which the developing rubber roller 10 is mounted.

The shaft 2 is made of metal such as aluminum, aluminum alloy, SUS or iron or ceramics.

The sealing portion 3 is made of nonwoven cloth such as Teflon (registered trademark) or a sheet.

The method of producing the semiconductive rubber roller shown in FIG. 1 is described below.

After components constructing the toner-transporting portion 1 are kneaded by using a Banbury mixer, a mixture thereof is tubularly preformed by using a rubber extruder. After the preformed tube is vulcanized at 160° C. for 15 to 70 minutes, a shaft 2 is inserted into a hollow portion of the tube, bonded thereto, and the surface thereof is polished. After the tube is cut to a predetermined size, it is polished appropriately so that it is roller-shaped. The optimum vulcanizing time period should be set by using a vulcanization testing rheometer (for example, curelastmeter). The vulcanization temperature may be set around 160° C. in dependence on necessity. A foamed roller may be formed by adding a foaming agent to the rubber component.

After the roller is washed with water, an oxide film is formed on the surface of the outermost layer. More specifically, by using an ultraviolet ray irradiation lamp, the surface of the outermost layer is irradiated with ultraviolet rays (wavelength: 184.9 nm and 253.7 nm) at intervals of 90 degrees in its circumferential direction for five minutes and with the ultraviolet ray irradiation lamp spaced at 10 cm from the semiconductive rubber roller 10. The roller is rotated by 90 degrees four times to form the oxide film on its entire peripheral surface (360 degrees).

In the first embodiment of the rubber component composing the toner-transporting portion 1, an epichlorohydrin copolymer and chloroprene rubber are used in combination. In addition, the vulcanized rubber contains a phthalocyanine compound, a dielectric loss tangent-adjusting agent, a vulcanizing agent, and an acid-accepting agent.

As the epichlorohydrin copolymer, an ethylene oxide-epichlorohydrin-allyl glycidyl ether terpolymer is used. The content ratio among the ethylene oxide, the epichlorohydrin, and the allyl glycidyl ether is 60 to 80 mol %:15 to 40 mol %:2 to 6 mol %.

As the chloroprene rubber, chloroprene rubber not containing sulfur is used.

Supposing that the total mass of the rubber component is 100 parts by mass, the content of the epichlorohydrin copolymer and that of the chloroprene rubber are 25 to 45 parts by mass and 55 to 75 parts by mass respectively.

It is favorable to use copper phthalocyanine or halogenated copper phthalocyanine as the phthalocyanine compound and more favorable to use the halogenated copper phthalocyanine.

The halogenated copper phthalocyanine is formed by substituting a part or all of 16 hydrogen atoms of the copper phthalocyanine with chlorine atoms or bromine atoms. It is possible to use the phthalocyanine compound in which the chlorine atoms or the bromine atoms are introduced at various ratios. It is favorable to use a compound containing not less than eight halogen atoms in one molecule of the copper phthalocyanine on average. It is more favorable that the halogen atoms consist of the chlorine atoms.

The mixing amount of the phthalocyanine compound for 100 parts by mass of the rubber component is set to 0.1 to 30 parts by mass. The mixing amount of the phthalocyanine compound for 100 parts by mass of the rubber component is set to favorably 0.5 to 20 parts by mass, more favorably 1 to 15 parts by mass, and most favorably 3 to 10 parts by mass.

The weakly conductive carbon black is used as the dielectric loss tangent-adjusting agent. It is preferable to use the weakly conductive carbon black which has a primary particle diameter of 100 to 250 nm and is spherical or nearly spherical. It is also preferable to use the weakly conductive carbon black having an iodine absorption amount of 10 to 40 mg/g and favorably 10 to 30 mg/g and a DBP oil absorption amount of 25 to 90 ml/100 g and favorably 25 to 55 ml/100 g. The mixing amount of the weakly conductive carbon black is set to 20 to 70 parts by mass for 100 parts by mass of the rubber component.

It is preferable to use sulfur and thioureas in combination as the vulcanizing agent.

The mixing amount of the sulfur for 100 parts by mass of the rubber component is set to favorably not less than 0.2 parts by mass nor more than 1 part by mass.

As the thioureas, it is preferable to use ethylene thiourea. The mixing amount of the thioureas for 100 parts by mass of the rubber component is set to favorably not less than 0.1 nor more than 5 parts by mass and more favorably not less than 0.5 nor more than 3 parts by mass.

As the acid-accepting agent, it is favorable to use hydrotalcites and magnesium oxide and more favorable to use the hydrotalcites. The mixing amount of the acid-accepting agent is set to 1 to 5 parts by mass for 100 parts by mass of the rubber component.

In the second embodiment of the rubber component composing the toner-transporting portion 1, the chloroprene rubber and NBR are used in combination. In addition, the vulcanized rubber contains the phthalocyanine compound, an electroconductive material, the vulcanizing agent, and the acid-accepting agent.

As the chloroprene rubber, the chloroprene rubber not containing sulfur is used.

As the NBR, low-nitrile NBR in which the amount of acrylonitrile is not more than 25% is used.

Supposing that the total mass of the rubber component is 100 parts by mass, the content of the chloroprene rubber and that of the NBR are set to 55 to 75 parts by mass and 25 to 45 parts by mass respectively.

In blending the chloroprene rubber and the NBR with each other, the apparent SP value computed from the mixing ratios thereof is so adjusted to be not less than 18.0 $(MPa)^{1/2}$.

It is favorable to use the conductive carbon black as the electroconductive material. It is more favorable to use the acetylene black as the electroconductive material. The mixing amount of the electroconductive material is set to favorably 5 to 25 parts by mass and more favorably 10 to 20 parts by mass for 100 parts by mass of the rubber component.

The phthalocyanine compound, the vulcanizing agent, and the acid-accepting agent are similar to those used in the first embodiment.

In the third embodiment of the rubber component composing the toner-transporting portion 1, the epichlorohydrin copolymer, the chloroprene rubber, and a polyether copolymer are used in combination. In addition, the vulcanized rubber contains the phthalocyanine compound, the dielectric loss tangent-adjusting agent, the vulcanizing agent, the acid-accepting agent, and an ionic-conductive material as desired.

The epichlorohydrin copolymer and the chloroprene rubber are similar to those used in the first embodiment.

As the polyether copolymer, an ethylene oxide-propylene oxide-allyl glycidyl ether terpolymer is used. The content ratio among the ethylene oxide, the propylene oxide, and the allyl glycidyl ether is 80 to 95 mol %:1 to 10 mol %:1 to 10 mol %. The number-average molecular weight Mn of the terpolymer is favorably not less than 10,000, more favorably not less than 30,000, and most favorably not less than 50,000.

Supposing that the total mass of the rubber component is 100 parts by mass, the content of the epichlorohydrin copolymer, that of the polyether copolymer, and that of the chloroprene rubber are set to 15 to 40 parts by mass, 5 to 20 parts by mass, and 40 to 80 parts by mass respectively.

The phthalocyanine compound, the dielectric loss tangent-adjusting agent, the vulcanizing agent, and the acid-accepting agent are similar to those used in the first embodiment.

Quaternary ammonium salt is preferable as the ionic-conductive material which is added to the rubber component as desired. The mixing amount of the ionic-conductive material for 100 parts by mass of the rubber component is set to favorably 0.1 to 5 parts by mass and more favorably 0.5 to 3 parts by mass.

The electric resistance value of the semiconductive rubber roller of the present invention which is measured at the temperature of 23° C. and the humidity of 55% is in the range of $10^5$ to $10^7\Omega$, when the voltage of 100V is applied thereto.

In the present invention, the adhesiveness of the toner to the semiconductive rubber roller is reduced, and the toner can be effectively moved by the static electricity (Coulomb force). Consequently when the semiconductive rubber roller of the present invention is incorporated in a printer as a developing roller, the print concentration does not drop. More specifically, supposing that the transmission density of a first sheet on which a black solid image is printed is CO and that the transmission density of a sheet on which the black solid image is printed after 1% print is carried out on 2,000 sheets of paper is C 2000, C 2000/C0≧1.

EXAMPLES 1 THROUGH 10 AND COMPARISON EXAMPLES 1 THROUGH 3

Components (numerical values shown in tables 1 and 2 indicate parts by mass) shown in table 1 were kneaded by a Banbury mixer. Thereafter the kneaded components were extruded by a rubber extruder to obtain a tube having an outer diameter of ϕ22 mm and an inner diameter of ϕ9 mm to ϕ9.5 mm. The tube was mounted on a shaft having ϕ8 mm for vulcanizing use. After the rubber component was vulcanized in a vulcanizing can for one hour at 160° C., the tube was mounted on a shaft, having a diameter of ϕ10 mm, to which a conductive adhesive agent was applied. The tube and the shaft were bonded to each other in an oven at 160° C. After the ends of the tube were cut, traverse abrasion was carried out with a cylindrical abrading machine. Thereafter the surface of the tube was abraded to a mirror-like surface finish to set the surface roughness Rz thereof to the range of 3 to 5 μm. The surface roughness Rz was measured in accordance with JIS B 0601 (1994). As a result, a semiconductive rubber roller of each example and comparison example having a diameter of ϕ20 mm (tolerance: 0.05 mm) was obtained.

After the surfaces of each of the semiconductive rubber rollers was washed with water, the surface thereof was irradiated with ultraviolet rays to form an oxidized layer thereon. By using an ultraviolet ray irradiation lamp ("PL21-200" produced by SEN LIGHTS CORPORARION), the surface of each semiconductive rubber roller was irradiated, with ultraviolet rays (wavelength: 184.9 nm and 253.7 nm) at intervals of 90 degrees in its circumferential direction for five minutes and with the ultraviolet ray irradiation lamp at 10 cm spaced from the semiconductive rubber roller. Each semiconductive rubber roller was rotated by 90 degrees four times to form the oxide film on its entire peripheral surface (360 degrees).

TABLE 1

| | | Comparison Example 1 | Comparison Example 2 | Example 1 | Example 2 | Example 3 |
|---|---|---|---|---|---|---|
| Chloroprene rubber | | 65 | 65 | 65 | 65 | 65 |
| Epichlorohydrin copolymer | | 35 | 35 | 35 | 35 | 35 |
| NBR | | | | | | |
| Polyether copolymer | | | | | | |
| Phthalocyanine compound | | — | 0.05 | 0.1 | 0.2 | 0.5 |
| Weakly conductive carbon black | | 40 | 40 | 40 | 40 | 40 |
| Conductive carbon black | | | | | | |
| Quaternary ammonium salt | | | | | | |
| Hydrotalcite | | 3 | 3 | 3 | 3 | 3 |
| Powder sulfur | | 0.5 | 0.5 | 0.5 | 0.5 | 0.5 |
| Ethylene thiourea | | 1.4 | 1.4 | 1.4 | 1.4 | 1.4 |
| Oxide film of surface layer | | Formed | Formed | Formed | Formed | Formed |
| Electric resistance (Ω) of roller | | 6.4 | 6.4 | 6.4 | 6.4 | 6.4 |
| Print | C0 | 1.81 | 1.81 | 1.80 | 1.80 | 1.79 |
| concentration | C2000 | 1.71 | 1.72 | 1.80 | 1.80 | 1.84 |
| | change rate (%) of concentration | 94 | 95 | 100 | 100 | 103 |
| Charged amount | T0(μC/g) | 40.2 | 40.5 | 42.5 | 43.0 | 43.2 |
| of toner | T2000(μC/g) | 37.2 | 37.4 | 38.0 | 38.2 | 39.1 |

| | | Example 4 | Example 5 | Example 6 | Example 7 | Comparison Example 3 |
|---|---|---|---|---|---|---|
| Chloroprene rubber | | 65 | 65 | 65 | 65 | 65 |
| Epichlorohydrin copolymer | | 35 | 35 | 35 | 35 | 35 |
| NBR | | | | | | |
| Polyether copolymer | | | | | | |
| Phthalocyanine compound | | 3 | 10 | 28 | 30 | 35 |
| Weakly conductive carbon black | | 40 | 40 | 40 | 40 | 40 |
| Conductive carbon black | | | | | | |
| Quaternary ammonium salt | | | | | | |
| Hydrotalcite | | 3 | 3 | 3 | 3 | 3 |
| Powder sulfur | | 0.5 | 0.5 | 0.5 | 0.5 | 0.5 |
| Ethylene thiourea | | 1.4 | 1.4 | 1.4 | 1.4 | 1.4 |
| Oxide film of surface layer | | Formed | Formed | Formed | Formed | Formed |
| Electric resistance (Ω) of roller | | 6.4 | 6.4 | 6.5 | 6.5 | 6.5 |
| Print | C0 | 1.75 | 1.75 | 1.72 | 1.70 | 1.65 |
| concentration | C2000 | 1.85 | 1.83 | 1.73 | 1.70 | 1.60 |
| | change rate (%) of concentration | 106 | 105 | 101 | 100 | 97 |
| Charged amount | T0(μC/g) | 44.0 | 44.3 | 48.2 | 48.8 | 51.0 |
| of toner | T2000(μC/g) | 40.0 | 39.5 | 45.0 | 46.0 | 48.9 |

TABLE 2

| | Example 8 | Example 9 | Example 10 |
|---|---|---|---|
| Chloroprene rubber | 65 | 65 | 65 |
| Epichlorohydrin copolymer | | 25 | 25 |
| NBR | 35 | | |
| Polyether copolymer | | 10 | 10 |
| Phthalocyanine compound | 3 | 3 | 3 |
| Weakly conductive carbon black | | 40 | 40 |
| Conductive carbon black | 18 | | |
| Quaternary ammonium salt | | | 1 |
| Hydrotalcite | 3 | 3 | 3 |
| Powder sulfur | 0.5 | 0.5 | 0.5 |
| Ethylene thiourea | 1.4 | 1.4 | 1.4 |
| Oxide film of surface layer | Formed | Formed | Formed |
| Electric resistance (Ω) of roller | 5.2 | 6.0 | 5.4 |

TABLE 2-continued

| | | Example 8 | Example 9 | Example 10 |
|---|---|---|---|---|
| Print concentration | C0 | 1.72 | 1.81 | 1.85 |
| | C2000 | 1.80 | 1.88 | 1.90 |
| | change rate (%) of concentration | 105 | 104 | 103 |
| Charged amount of toner | T0(μC/g) | 48.0 | 40.7 | 38.2 |
| | T2000(μC/g) | 44.0 | 37.2 | 35.0 |

As the components of the semiconductive rubber roller of each of the examples and the comparison examples, the following substances were used:

(a) Rubber Component

Chloroprene rubber: "Shoprene (Showa Denko Chloroprene) WRT" produced by Showa Denko K. K. (Sp value: 19.19)

Epichlorohydrin copolymer: EO (ethylene oxide)/EP (epichlorohydrin)/AGE (allyl glycidyl ether)=73 mol %/23 mol %/4 mol %, commercial name: "Epion ON301" produced by DAISO CO., LTD.

NBR: "Nipol DN401LL" produced by Zeon Corporation (content of acrylonitrile: 18%, SP value: 17.8)

Polyether copolymer: "Zeospan ZSN8030" produced by Zeon Corporation

EO (ethylene oxide)/PO (propylene oxide)/AGE (allyl glycidyl ether)=90 mol %/4 mol %/6 mol %

(b) Phthalocyanine Compound

Halogenated copper phthalocyanine: "IRGALITE Green GFNP" produced by NAGASE & CO., LTD.

(c) Other Components

Weakly conductive carbon black: "Asahi #8" produced by Asahi Carbon Co., Ltd.

average primary particle diameter: 120 nm, DBP oil absorption amount: 29 ml/100 g, iodine adsorption amount: 14 mg/g Conductive carbon black: "Denka Black" produced by DENKI KAGAKU KOGYO KABUSHIKI KAISHA.

Quaternary ammonium salt: "KP4728" produced by KAO CORPORATION.

Hydrotalcite (acid-accepting agent): "DHT-4A-2" produced by Kyowa Chemical Industry Co., Ltd.

Powdery sulfur (vulcanizing agent)

Ethylene thiourea (vulcanizing agent): "Accel 22-S" produced by Kawaguchi Chemical Industry Co., Ltd.

The following properties of the semiconductive rubber roller of each of the examples and the comparison examples were measured. Results are shown in tables 1 and 2.

Measurement of Electric Resistance of Roller

Figure 2:
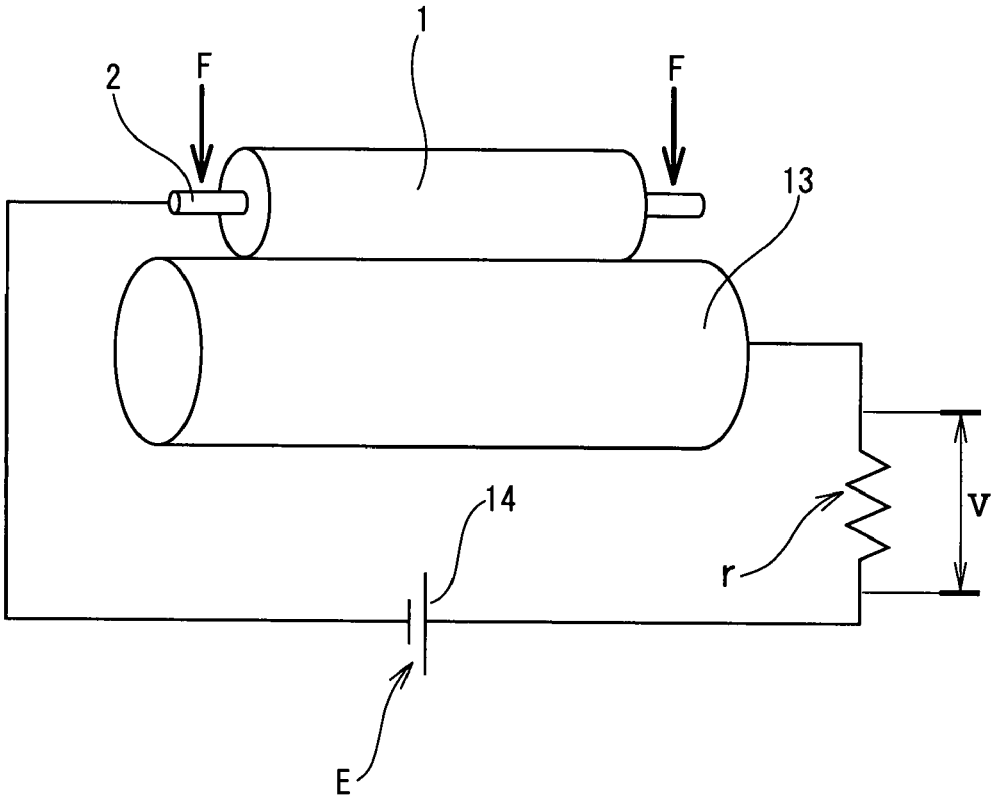
FIG. 2 shows a method of measuring the electric resistance of the semiconductive rubber roller of the present invention
Figure 3:
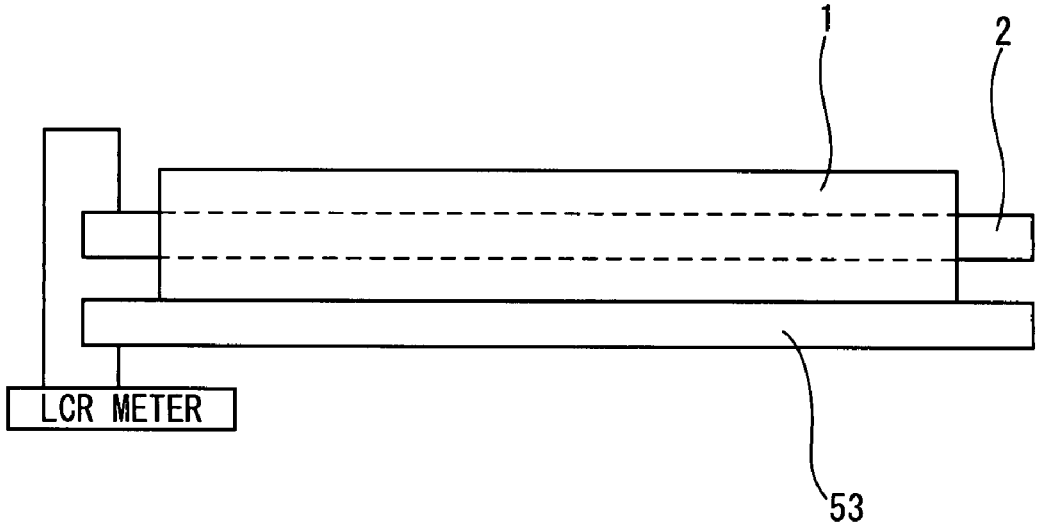
FIG. 3 shows a method of measuring the dielectric loss tangent of the semiconductive rubber roller of the present invention.
Figure 4:
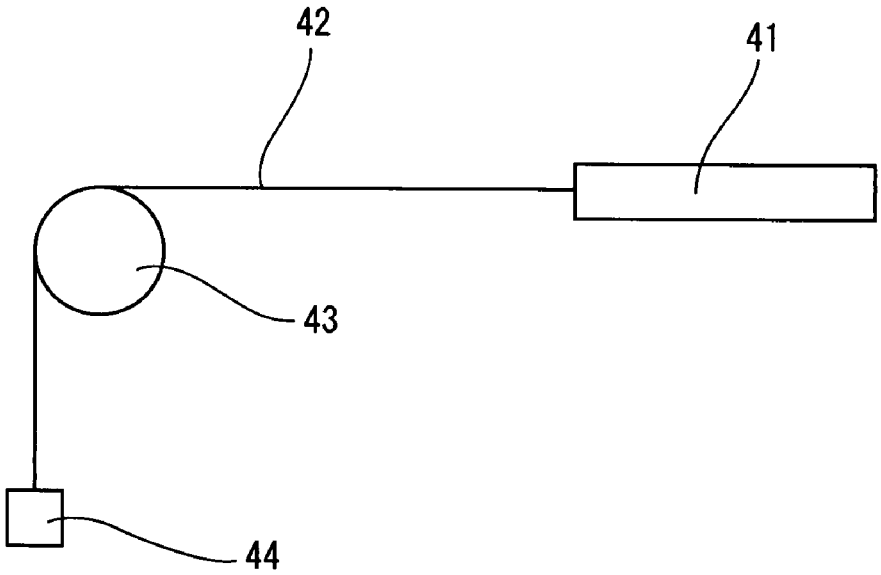
FIG. 4 shows a method of measuring the friction coefficient of the semiconductive rubber roller of the present invention.

To measure the electric resistance of each roller, as shown in FIG. 2, a toner-transporting portion 1 through which the shaft 2 was inserted was mounted on an aluminum drum 13, with the toner-transporting portion 1 in contact with the aluminum drum 13. A leading end of a conductor having an internal electric resistance of r (100Ω) connected to a positive side of a power source 14 was connected to one end surface of the aluminum drum 13. A leading end of a conductor connected to a negative side of the power source 14 was connected to other-side end surface of the toner-transporting portion 1.

A voltage V applied to the internal electric resistance r of the conductor was detected. Supposing that a voltage applied to the apparatus is E, the electric resistance R of the roller is: $R=r\times E/(V-r)$. Because the term of $-r$ is regarded as being extremely small, $R=r\times E/V$. A load F of 500 g was applied to both ends of the shaft 2. A voltage E of 100V was applied to the roller, while it was being rotated at 30 rpm. The detected voltage V was measured at 100 times during four seconds. The electric resistance R was computed by using the above equation. The measurement was conducted at a constant temperature of 23° C. and a constant humidity of 55%.

In table 1, the electric resistance values are shown by $\log_{10}R$.

Evaluation of Adhesion of Toner to Semiconductive Rubber Roller

To examine the adhesiveness of the toner to the semiconductive rubber roller, the semiconductive rubber roller of each of the examples and the comparison examples was mounted on a laser printer (commercially available printer in which unmagnetic one-component toner is used. Recommended number of sheets for toner is about 7000) as a developing roller. The performance of each semiconductive rubber roller was evaluated by setting the change in a toner amount consumed as an image, namely, by setting the change in the amount of the toner deposited on a printed sheet as the index. The amount of the toner deposited on the printed sheet can be measured by measuring a transmission density shown below.

More specifically, after a black solid image was printed, the transmission density was measured with a reflection transmission densitometer ("TECHKON densitometer RT120/light table LP20 produced by TECHKON Co., Ltd.) at given five points on each of obtained printed sheets. The average value of the measured transmission densities was set as the evaluation value (indicated as ("C0") in tables 1 and 2).

After 1% print was carried out on 2,000 sheets of paper, the black solid image was printed. In a manner similar to that described above, the transmission density was also measured on the obtained sheets on which the black solid image was printed. The average value of the measured transmission densities was set as the evaluation value (indicated as ("C 2000") in tables 1 and 2). The reason the transmission density was measured after printing was carried out on 2,000 sheets of paper is because break-in is finished, when printing is carried out on about 2,000 sheets of paper.

The change of rate (%)=C 2000/C0 was computed from obtained values.

Evaluation of Charged Amount of Toner

Evaluation of the charged amount of the toner was made as described below to examine whether the change of the charged amount of the toner affected the change of the transmission density of the printed sheet measured by the above-described manner.

More specifically, after a black solid image was printed, a white solid image (white paper) was printed. Thereafter a cartridge was removed from a laser printer to suck toner from above from a developing roller mounted on the cartridge by using a charged amount-measuring machine of absorption type ("Q/M METER Model 210HS-2 produced by TREK INC.) so that a charged amount (μC) and a mass (g) of the toner were measured. The amount of static electricity per mass was computed (indicated as "T0" in tables 1 and 2) as the charged amount (μC/g) of the toner. That is, the charged amount (μC/g) of toner=charged amount (μC)/mass (g) of toner.

After 1% print was carried out on 2,000 sheets of paper, the black solid image was printed. Thereafter the white solid image (white paper) was printed as 2,002th sheet of paper. Thereafter the charged amount (indicated as "T 2000" in tables 1 and 2) of the toner was measured in a manner similar to that described above.

It is known that the more the toner is used, the lower is the charged amount thereof and consequently the higher is the amount of the toner deposited on the printed sheet, i.e., the higher is the transmission density of the printed sheet. The reason this phenomenon occurs is as follows: The difference between the potential of the developing roller and that of the electrophotographic photoreceptor is compensated by the charged amount of the toner, and the above-described potential difference is proportional to the charged amount of the toner, namely, charged amount (μC/g) of toner×mass (g) of toner. Therefore so long as the difference between the potential of the developing roller and that of the electrophotographic photoreceptor is constant, the mass of the toner increases when the charged amount of the toner decreases.

In the comparison examples 1 through 3, although the charged amount of the toner decreased to some extent, the transmission density of the printed sheet did not increase but decreased. This is because a part of the toner adhered to the developing roller.

On the other hand, in the examples 1 through 10, the transmission density of the printed sheet increased with a decrease of the charged amount of the toner. It could be confirmed that unlike the comparison examples 1 through 3, a phenomenon that the toner adhered to the developing roller did not occur.

What is claimed is:

1. A semiconductive rubber roller comprising a toner-transporting portion formed as an outermost layer on the rubber roller, wherein the toner transporting portion has a thickness of 3 to 15 mm and is formed essentially of vulcanized rubber containing 0.1 to 30 parts by mass of halogenated copper phthalocyanine for 100 parts by mass of a rubber component of said vulcanized rubber, said rubber component comprising a combination of chloroprene rubber and epichlorohydrin copolymer, a combination of chloroprene rubber, epichlorohydrin copolymer and polyether copolymer, or a combination of chloroprene rubber and acrylonitrile butadiene rubber, wherein said semiconductive rubber roller has an electrical resistance value measured at a temperature of 23° C. and a humidity of 55% in a range of $10^3$ to $10^9$ Ω, when a voltage of 100V is applied thereto.

2. The semiconductive rubber roller according to claim 1, wherein said vulcanized rubber contains chlorine atoms.

3. The semiconductive rubber roller according to claim 1, wherein said vulcanized rubber consists of an ionic-conductive rubber containing a dielectric loss tangent-adjusting agent.

4. The semiconductive rubber roller according to claim 2, wherein said vulcanized rubber consists of an ionic-conductive rubber containing a dielectric loss tangent-adjusting agent.

5. The semiconductive rubber roller according to claim 3, wherein said ionic-conductive rubber contains an ionic-conductive material to allow said ionic-conductive rubber to be ionic-conductive.

6. The semiconductive rubber roller according to claim 1, wherein said vulcanized rubber contains an electroconductive material and has an SP value of not less than 18.0 $(MPa)^{1/2}$.

7. The semiconductive rubber roller according to claim 2, wherein said vulcanized rubber contains an electroconductive material and has an SP value of not less than 18.0 $(MPa)^{1/2}$.

8. The semiconductive rubber roller, according to claim 1, wherein said semiconductive rubber roller is a developing roller, in which non-magnetic one-component toner is used, for use in a developing device of an image-forming mechanism of an electrophotographic apparatus.

9. A semiconductive rubber roller comprising a toner-transporting portion formed as an outermost layer on the rubber roller, wherein the toner transporting portion has a thickness of 3 to 15 mm and is formed essentially of vulcanized rubber containing 0.1 to 30 parts by mass of halogenated copper phthalocyanine for 100 parts by mass of a rubber component of said vulcanized rubber, said rubber component comprising at least two rubbers selected from the group consisting of chloroprene rubber, epichlorohydrin copolymer, and acrylonitrile butadiene rubber, wherein said semiconductive rubber roller has an electrical resistance value measured at a temperature of 23° C. and a humidity of 55% in a range of $10^3$ to $10^9$Ω, when a voltage of 100V is applied thereto.

* * * * *